United States Patent [19]

Leahy

[11] Patent Number: 4,486,032

[45] Date of Patent: Dec. 4, 1984

[54] COVER FOLDERS

[75] Inventor: David J. Leahy, Framingham, Mass.

[73] Assignee: Dennison Manufacturing Company, Framingham, Mass.

[21] Appl. No.: 387,892

[22] Filed: Jun. 14, 1982

[51] Int. Cl.[3] ..... B42D 3/10; B42D 17/00; B42F 9/00; B42F 1/06

[52] U.S. Cl. ..... 281/46; 281/45; 281/48; 281/49; 402/46; 24/67 R

[58] Field of Search ..... 281/45, 66, 67, 49; 402/45, 74, 46, 80, 17; 412/34; 24/67 R, 67.3

[56] References Cited

U.S. PATENT DOCUMENTS

| | | | |
|---|---|---|---|
| 1,478,219 | 12/1928 | Hammitt | 24/67.3 |
| 3,252,462 | 5/1966 | Quarton et al. | 281/49 |
| 3,296,673 | 1/1967 | Kirkpatrick | 24/67 R |
| 4,351,546 | 9/1982 | Cognata | 412/34 |
| 4,391,457 | 7/1983 | Gassner | 402/46 |

FOREIGN PATENT DOCUMENTS

| | | | |
|---|---|---|---|
| 820746 | 8/1969 | Canada | 402/74 |
| 2448443 | 5/1980 | France | 402/80 |
| 652040 | 4/1951 | United Kingdom | 402/47 |

*Primary Examiner*—Robert L. Spruill
*Assistant Examiner*—Paul M. Heyrana, Sr.
*Attorney, Agent, or Firm*—Barry D. Josephs; George E. Kersey

[57] ABSTRACT

Cover folders having binders that securely retain the cover and inserted sheets, without the use of external fasteners. The binder is an elongated bar with an interior channel for receiving and holding a folded cover. The bar includes within the channel slanted ribs which engage the folded edge of the cover sheet along an overlapping flap. The overlapping flap of the cover sheet may be made more rigid by heat treatment and/or by a reinforcing coating.

10 Claims, 14 Drawing Figures

FIG. 1
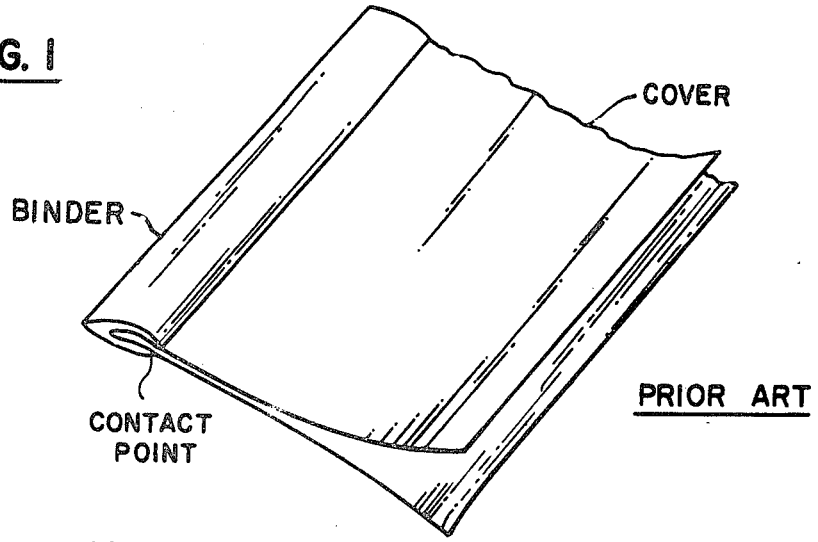
PRIOR ART
FIG. 2
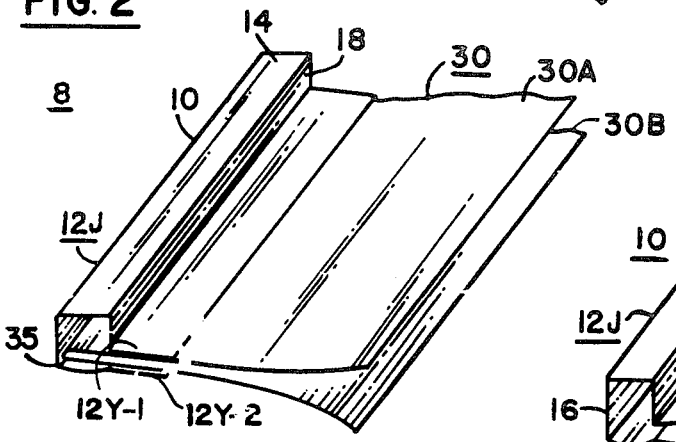
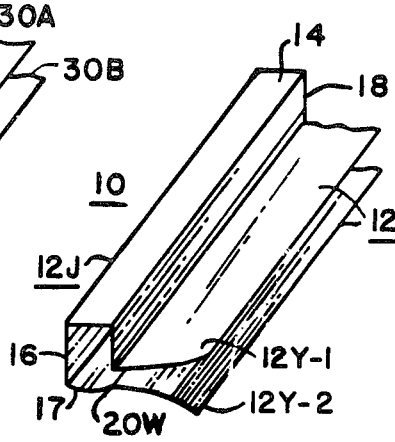
FIG. 2A
FIG 3
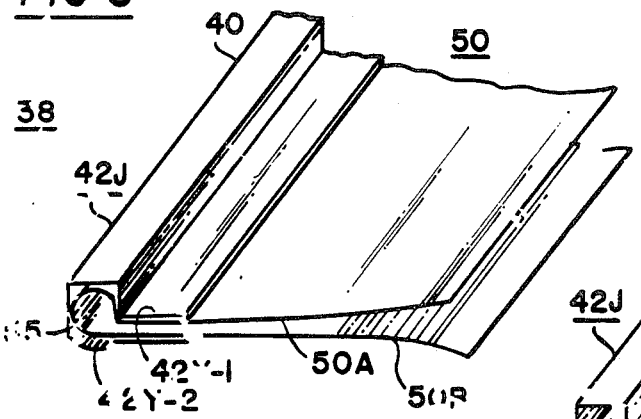
FIG 3A
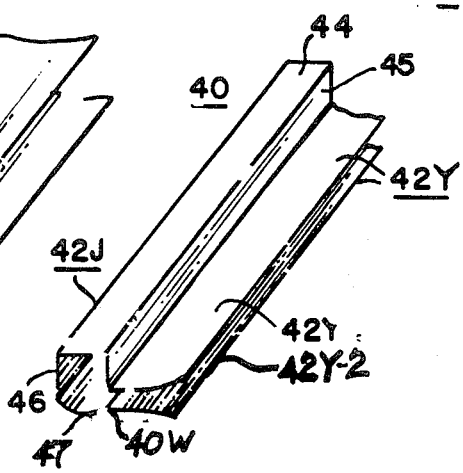

FIG. 4A
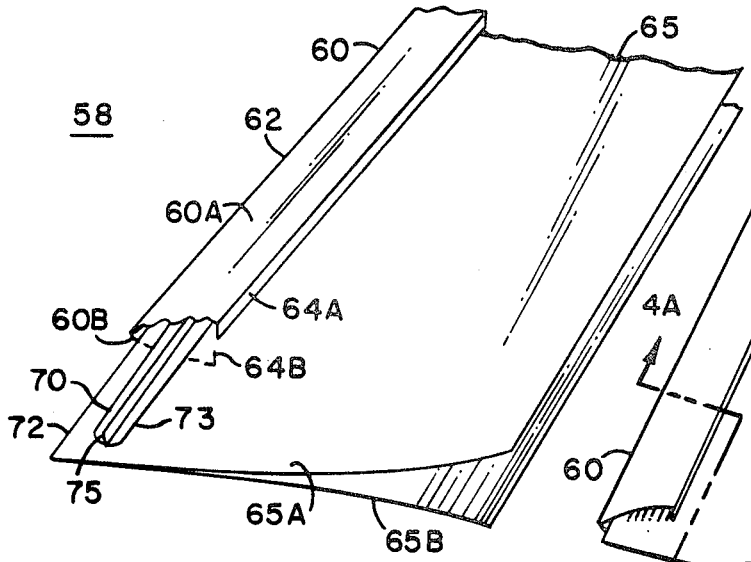
FIG. 4
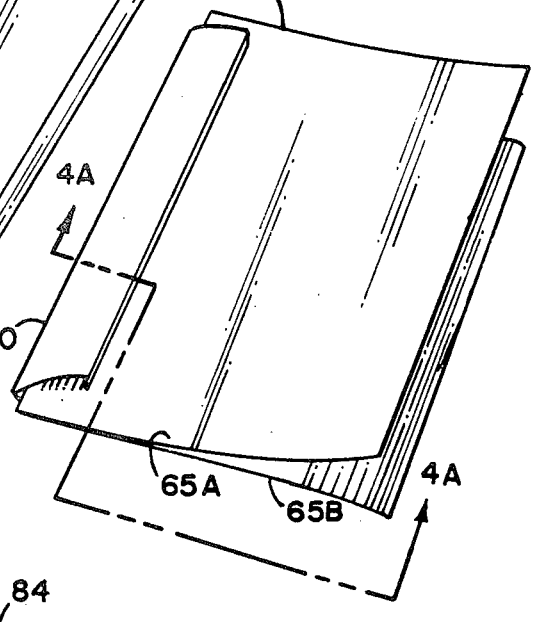
FIG. 5 A
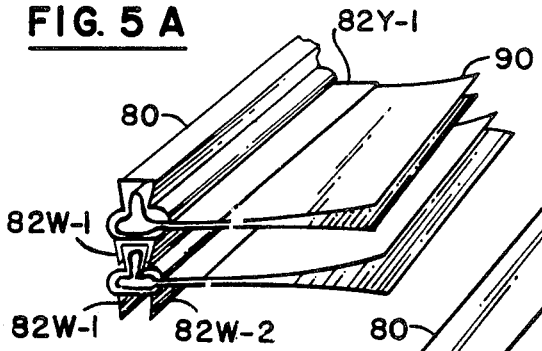
FIG. 5
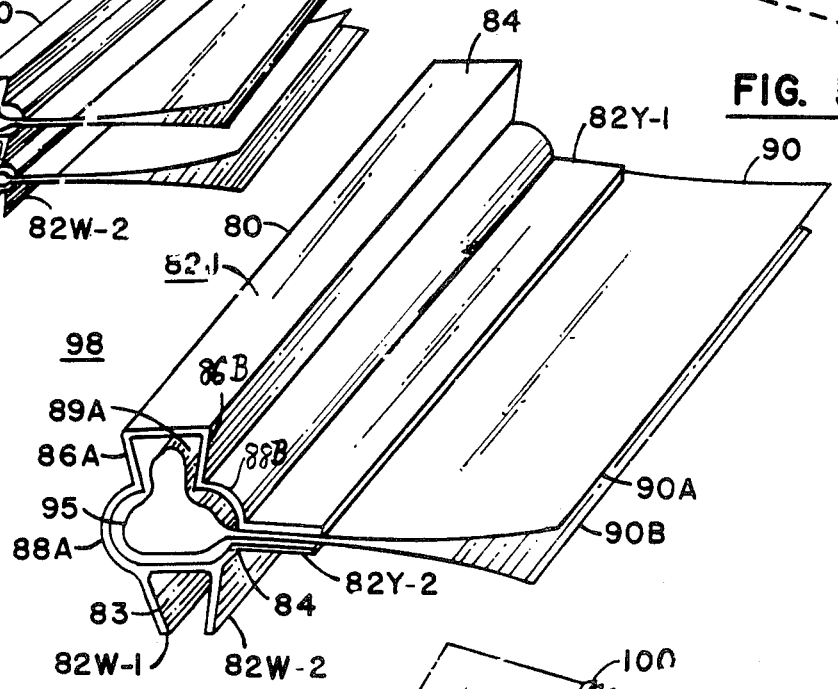
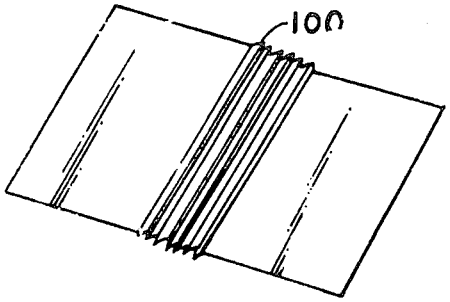
FIG. 6

FIG. 7
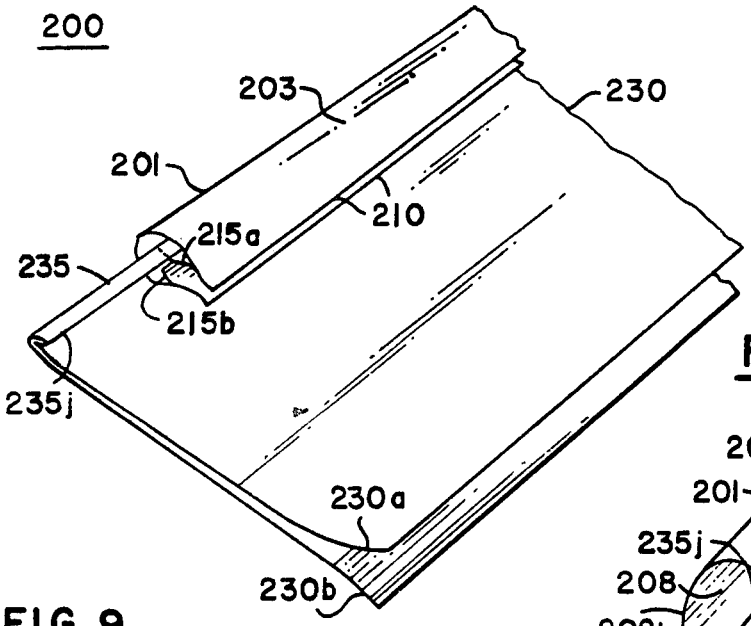
FIG. 8
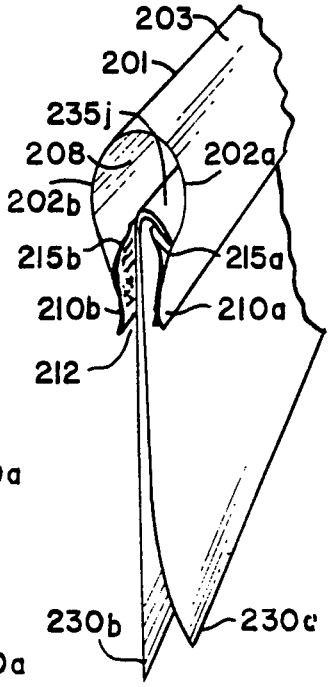
FIG. 9
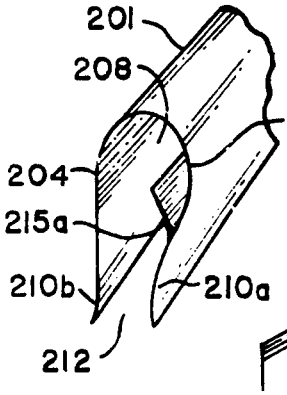
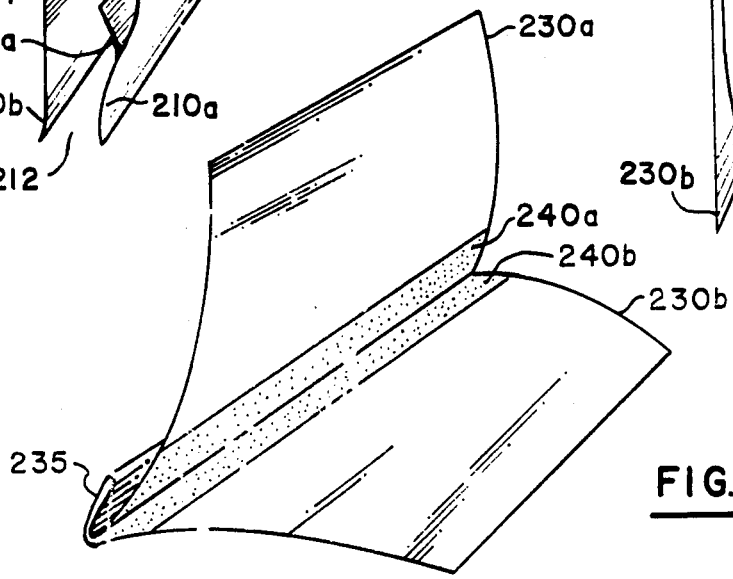
FIG. 10

COVER FOLDERS

BACKGROUND OF THE INVENTION

1. Field of the Invention

The present invention relates to cover folders for sheets of paper, and in particular to binders for securing the sheets within the cover folders.

2. Description of the Prior Art

Patent application Ser. No. 343,677 filed Jan. 28, 1982 entitled "Cover Foldrs" by David Leahy, Lee Carlson, John Capezzuto and Warren Pitts commonly assigned with the present patent application, contains related and common subject matter.

Cover folders for holding sheets of paper are conventionally available in the form of folded sheets of either plastic or paper. These cover folders typically include a plastic or metal binder placed along the folded edge of the cover. Such binders are generally formed by two elongated panels that are joined along a common edge, with a narrow opening along the opposite edge of the binder through which a cover may be inserted. A typical cover folder of this prior art design is illustrated in part in FIG. 1.

Prior art cover folders have the disadvantage that when the cover sheet is opened and separated, even with only slight force, it tends to separate from its binder. In particular, there generally is insufficient friction between the binder and the cover to keep the two together thus requiring an adhesive or other binding element to ensure secure engagement. Additionally, when sheets of paper are inserted into the cover and the cover opened, the sheets of paper tend to slip from the binder. Other prior art cover folders contain fasteners which must be inserted through the binder, cover, and sheets of paper held therein. Use of such fasteners necessitates the need for holes along the cover edge as well as along at least one edge of the inserted sheets. Such holes are undesirable since the sheets tend to tear during normal handling. The use of fasteners makes it more difficult and time consuming for the user to insert and remove the sheets. Furthermore, the edge holes tend to detract from the appearance of documents containing them.

Accordingly, it is an object of the present invention to provide an improved report cover which is securely held in a binder without the use of external fastening devices. A related object is to provide a binder which securely holds the cover and inserted sheets even when the cover is opened.

Another object of the invention is to provide a folder of the type containing a binder and folded cover sheet wherein the cover sheet is readily insertable and removable from the binder.

It is a further object of the invention to provide a report folder which may be joined to other like folders to form a single unit of stacked report folders.

SUMMARY OF THE INVENTION

In accomplishing the foregoing and related objects, the invention provides a folder consisting of a binder spline and a folded cover insertable within the binder spline. The cover and inserted sheets of paper are securely held in place by the binder even when the cover is opened.

In one aspect of the invention, the binder spline is formed of an elongated bar having an interior channel or slot. The binder spline preferably has at least one outwardly curved panel and preferably a pair of such panels, which define the interior slot or channel.

The interior channel communicates with a slit along its length, which slit is defined by the thermal edges of each of the curved panels. A rib protrudes into the interior channel from the interior face of at least one of the panels preferably from the curved panel or panels. The ribs are slanted inwardly away from the slit edge of the binder so that they form an obtuse angle with the entrance area of the panels adjacent the slit. Preferably, the slanted rib extends along at least a major portion of the binder's length.

The folded cover advantageously comprises a single sheet of thermoplastic or paperboard folded once to form a cover sheet, and again to form an overlapping flap. The cover folder is secured to the binder by inserting a portion of the overlapped folded edge into the slit opening of the binder at one end until the protruding ribs of the binder capture the overlapping flap of the cover folder. The binder may then be easily slid along the remaining portion of the folded edge until the entire overlapping flap is securely locked within the binder. The cover sheet is thereupon securely bound within the binder and will not escape when the folder is opened. The binder exerts sufficient friction on the folded cover sheet so that papers placed within the cover sheet will not slip from the binder. The coefficient of friction may be increased by coating the inside surface of the cover sheet with a suitable material near the folded edge. The folded edge and overlapping flap of the cover sheet may be made more rigid by thermocrimping, or by applying a reinforcing polymer coating to these areas.

BRIEF DESCRIPTION OF THE DRAWINGS

FIG. 1 is a perspective view of a prior art design for a binder and cover;

FIG. 2 is a perspective view of a folder in accordance with a preferred embodiment, showing the binder securely fastened to the cover;

FIG. 2A is a perspective view of the binder of FIG. 2;

FIG. 3 is a perspective view of a folder of an alternative embodiment, with binder and cover engaged;

FIG. 3A is a perspective view of the binder illustrated in FIG. 3;

FIG. 4 is a perspective view of a folder showing a third embodiment for the binder and cover;

FIG. 4A is a cutaway view of the folder of FIG. 4;

FIG. 5 shows in perspective yet another embodiment of the folder of the invention;

FIG. 5A illustrates a stacked pair of folders of the type shown in FIG. 5;

FIG. 6 is a partial plan view of an alternative cover design to be utilized in the folder of the invention;

FIG. 7 is a perspective cutaway view of a folder in accordance with another preferred embodiment showing the binder securely fastened to the cover;

FIG. 8 is a perspective side view of the binder and cover illustrated in FIG. 7;

FIG. 9 is a perspective view of an alternative embodiment of a binder for use in securing the cover folder illustrated in FIG. 7 or 8; and FIG. 10 is a perspective view of the cover of FIG. 7 or 8 shown in an opened positon.

DETAILED DESCRIPTION

A preferred embodiment of the invention is illustrated in FIGS. 7–10. In this embodiment, folder 200 is composed of binder 201 and folded cover sheet 230 which is held securely within binder 201. Binder 201 is composed of an elongated bar 203 defining an interior slot 208 therethrough along its length. Bar 203 includes side walls formed preferably of a pair of outwardly curving panels 202*a* and 202*b* as best illustrated in FIG. 8. The panels 202*a* and 202*b* terminate at a nip between edges 210*a* and 210*b* defining a slit 212 along the length of bar 203.

Binder 201 includes at least one rib 215*a* protruding into slot 208 from at least one of the panels 202*a* and 202*b*, and preferably from each of these panels as illustrated best in FIG. 8. Preferably the rib 215*a* extends along at least a major portion of the length of bar 203, most preferably along its entire length. Ribs 215*a* and 215*b* protrude into slot 208 from side walls 202*a* and 202*b* respectively and face each other in slanted arrangement, i.e., so that an obtuse angle is formed between the intersection of each member 215*a* and 215*b* with side walls 202*a* and 202*b*, measured on the side closest toward slit opening 212. Preferably, the angle of intersection is between 115° to 145°. If oppositely positioned slanted ribs 215*a* and 215*b* are not employed but rather only one rib, then the side wall having no rib protruding therefrom, e.g. side surface 204, is preferably flat or even outwardly concave rather than convex as best illustrated in FIG. 9.

Although in the illustrated embodiment the projected members 215*a* and 215*b* take the form of elongated ribs, it is within the scope of the invention to employ members segmented along the length of bar 203. For example, member 215*a* might comprise a series of slanting prongs. The cover sheet 230 is formed preferably of a single sheet of plastic or paperboard which is folded to form sheets 230*a* and 230*b* and folded again to form a folded edge 235 with an overlapping flap 235*j*. The overlapping folded edge 235 may be formed by crimping, more preferably by thermocrimping, to increase the rigidity of overlapped folded edge 235. Additionally, overlapped edge 235 may be reinforced by coating with a hot melt or polymer solution, optionally in conjunction with the crimping process. Folded edge 235 and overlapping flap 235*j* may conveniently be reinforced with the same material as that forming cover folder 230. Thus, if polyvinylchloride is used in forming cover folder 230, the folded edge 235 and flap 235*j* after crimping may be coated with additional polyvinylchloride to increase the rigidity of these elements. The polymer used to coat folded edge 235 and flap 235*j* may be selected from any polymer compatible with and able to adhere to cover folder 230. Particularly suitable coating polymers may be cellulose acetate butyrate, polymethylmethacrylate and polycarbonate. Alternatively, the rigidity of folded edge 235 and overlapping flap 235*j* may be increased by applying a heavy adhesive tape thereto after the crimping operation.

The folder cover sheet 230 is secured to binder 201 after inserting any sheets to be bound, by inserting one end of the overlapped folded edge 235 into slit 212 and sliding it into slot 208 until rib 215*a* (or 215*b*) engages the overlapping flap 235*j*. Binder 201 may then be easily slid along the remaining length of edge 235 until all of the overlapping flap 235*j* is securely locked within slot 208 by rib 215*a* or 215*b*. Folder 230 is held securely within binder 201 by engagement of overlapping flap 235*j* with slanted member 215*a* or 215*b*, so that the folder 230 will not slip out of binder 201 when folder 230 is opened.

Cover folder 230 may have a coating 240*a* and 240*b* along the inside surface of cover sheet 230*a* and 230*b* respectively, near folded edge 235 to increase the coefficient of friction of these surfaces. The force exerted on folder 230 at the nip between lips 210*a* and 210*b*, together with the friction exerted between the paper sheets and coated strips 240*a* and 240*b* ensures that the bound sheets will not escape the folder when the cover sheet 230 is opened.

Cover folder 230 is illustratively comprised of a polyvinylchloride composition of thickness between about 4 to 10 mil, preferably 4 to 4.5 mil. Alternatively, polystyrene or polypropylene of the same range in thickness may be suitably used for cover folder 230. The cover folder 230 is conveniently manufactured by conventional cast rolling processes. Although the above-mentioned plastics for folder 230 are preferred, the invention is not intended to be limited to these compositions since a wide variety of thermoplastic materials, as well as fibrous materials such as paperboard, are also suitable and could readily be selected by persons skilled in the art as substitute materials.

Binder 201 is preferably composed of a thermoplastic material which is easily extrudable in the form illustrated in FIGS. 7–10. Polystyrene has been determined to be very suitable and is the preferred material for use in a one step extrusion of binder 201. However, binder 201 can be composed of a wide variety of other thermoplastics. Polypropylene, polyvinylchloride and nylon have been determined to be particularly suitable alternatives for polystyrene in forming binder 201.

If a friction coating 240A and 240B is employed in coating a portion of the inside surface of cover folder 230, a preferred coating material is a hot melt compound having good tack but yet poor adhesive bonding properties. A preferred hot melt of this type is one formed principally of ethyl vinyl acetate such as the group of hot melt adhesives sold under the THERMO-GRIP trademark available from the Bostik Division of U.S.M. Corp. in Middleton, MA.

Other embodiments of the cover folders of the invention are illustrated in FIGS. 2–6. One preferred embodiment of the folder and binder of the invention is illustrated in FIGS. 2 and 2A respectively. The folder 8 illustrated in FIG. 2 is composed of a binder spline 10 and folded cover sheet 30 which is securely engaged along its folded edge 35 by binder 10. Binder 10 has a length substantially equal to the length of folded edge 35 of the cover 30. Binder 10 is composed of a slotted member 12 and a pair of flat panels 12Y-1 and 12Y-2, in fixed relation to interior slot 12J. Panels 12Y-1 and 12Y-2 coextend from side surface 18 of the slotted member 12. The slot 12J is defined by top surface 14, side surfaces 16 and 18, and a slightly curved or flat bottom surface 17. Slot 12J takes the form of an elongated rectangular channel communicating with a slit 20W which is defined by the junction of panels 12Y-1 and 12Y-2, and by surfaces 17 and 18.

Cover 30 is insertable between panels 12Y-1 and 12Y-2 and into slot 12J. Since panels 12Y-1 and 12Y-2 are preferably slightly divergent, the vertical distance between these panels is less at slit 20W than along the outer edges of the panels. Therefore, cover 30 is readily inserted between panels 12Y-1 and 12Y-2, and may be held in place within binder 10 through the friction exerted on the cover 30 by the slit 20W and the panels. Advantageously, however, after cover 30 has been inserted into the receiving slot 12J, adhesive or glue is applied between the panels 12Y and the cover 30 so as to more securely hold the cover within binder 10. In this embodiment the cover 30 has a folded edge 35 which is formed simply by folding a sheet in half, thus forming top and bottom cover sheets 30A and 30B.

If adhesive is not used, cover 30 is held in place frictionally, which friction may be increased by coating the surface of the cover near the folded edge 35 with latex or an equivalent material. Alternatively, the friction may be increased by mechanically serrating the cover along the folded edge or by providing folds 100 as illustrated in FIG. 6 and extending about one inch from folded edge 35. Once the cover sheet is bound, papers or documents may be inserted between top cover 30A and bottom cover 30B and through slit 20W until the leading edge of the sheets contact the folded edge 35 of the cover. In this embodiment, binder 10 does not separate from cover 30 when cover sheet 30A and 30B are opened. The sheets inserted within cover 30 are securely held therein, and do not separate from receiving slot 12J when the cover 30 is opened.

The present invention is not restricted to any particular material for either the binder 10 or the cover 30. Typically, cover 30 is composed of plastic or paper; if plastic is used, polyvinylchloride, cellulose acetate, or polystyrene are particularly suitable plastics. Covers formed from such plastic materials are easily fabricated, for example, by calendering the molten plastic to form a sheet thereby, or the cover may be manufactured in other conventional molding or extrusion operations. The cover sheets may be clear, or dye may be added to the plastic during the molding stage to provide a cover of any desired color. The binder is preferably of a plastic material, such as, for example, extruded polystyrene. Also binder 10 may be composed of metals. Aluminum is a particularly suitable material when a stiffer binder is needed; for example, to hold heavy documents or sheets within cover 30.

An alternative embodiment of the invention is illustrated in FIGS. 3 and 3A. In this embodiment adhesive is not used to hold the cover securely to the binder. The binder 40, which is preferred in this alternate embodiment, is illustrated best in FIG. 3A. Binder 40 is essentially the same as binder 10 shown in FIG. 1A except that panels 42Y-1 and 42Y-2 are preferably parallel. The slot 42J is defined by top surface 44, side surfaces 45 and 46, and bottom surface 47. Surface 47, and panels 42Y-1 and 42Y-2 define a narrow passage 40W, which extends into the interior of slot 42-J. Cover 50 is first folded to form a looped edge 55 as illustrated in FIG. 3, and cover 50 is then inserted within binder 40 by sliding along the binder's axis.

Cover 50 is held securely bound to binder 40 by friction between looped edge 55 and the surfaces defining receiving slot 42J, as well as by friction exerted between panels 42Y and cover 50. Thus cover 50 is readily inserted within receiving slot 42J and is held securely therein even when the cover 50 is opened. There is enough space between panels 42Y-1 and 42Y-2 to permit insertion of paper sheets into cover 50. The paper sheets are inserted within cover 50 until they come into contact with looped edge 55. In this embodiment of the invention no adhesive need be used to keep cover 50 securely bound to binder 40. In this embodiment the cover 50 and sheets therein are held securely in place and do not separate from binder 40 when cover 50 is opened. Additionally, when cover 50 is opened, the sheets therein tend to lie flat, which makes it easier for the user to read from the sheets.

A third alternate embodiment of the invention is illustrated in FIGS. 4 and 4A. The folder 58 of FIG. 4A is composed of binder 60 and cover 65 held securely therein. Binder 60 consists of slightly curved panels 60A and 60B, in contrast to the flat panels of the other embodiments. Panels 60A and 60B intersect along one common edge 62 of binder 60. Binder 60 also is composed of a pair of elongated lips 64 which extend vertically and inwardly towards each other from each of the curved panels 60A and 60B so that a narrow opening is formed between the open edge of curved panels 60A and 60B as illustrated in FIG. 4A. Thus cover 65 may be folded to form folded edge 72 which is readily insertable between lips 64A and 64B and thence into the interior of binder 60 as shown in FIG. 4A.

In this embodiment of the invention cover 65 contains an elongated runner 70 placed on the outside surface of at least one of the cover sheets 65A or 65B and in close proximity to folded edge 72. Preferably a runner 70 is included on each one of the cover sheets 65A and 65B and positioned in close proximity to a common folded edge 72 of the cover. Runner 70 is composed of a flat support strip 73 having a bar 75 protruding therefrom along the length of support strip 73. Bar 75 may be composed of a thin member in substantially perpendicular alignment with support strip 73. Runner 70 composed of support strip 73 and bar 75 may be composed of plastic material which can be formed into the aforementioned configuration by conventional molding operations. Runner 70 may be formed in separate molding operations and then glued to cover sheet 65A and 65B in a second operation. Alternatively runner 70 may be formed integrally with the manufacture of cover 65 thus making it unnecessary to attach runner 70 to cover 65 in a second step.

Binder 60 is easily attached to cover 65 by inserting binder 60 over runner 70 and sliding the binder along the length of the folded edge 72. Conversely, the user may remove binder 60 simply by sliding it along the length of folded edge 72 in a direction parallel to folded edge 72 until the binder separates from cover 65. Thus, this embodiment of the invention allows for easy assembly and disassembly of the folder 58. Once folder 58 is assembled and cover 65 opened, bar 75 presses against lips 64A and 64B thus preventing cover 65 from slipping out of binder 60. The cover 65 may include folds such as folds 100 illustrated in FIG. 6 located along the folded edge with or without runner 70. As cover 65 is opened lips 64A and 64B engage folds 100 thus further reinforcing the cover within binder 60. Additionally, sheets of paper are easily inserted within cover 65 until the sheets press against folded edge 72. When cover 65 is opened the inserted sheets remain securely in place by pressure exerted thereon by lips 64A and 64B and friction of the cover sheets 65A and 65B so that the sheets do not separate from the binder when cover 65 is opened, and tend to lie flat.

A further embodiment of the invention is illustrated in FIGS. 5 and 5A. In this embodiment folder 98 is composed of binder 80 and folded cover sheet 90 which is held securely within binder 80. Binder 80 is composed of an elongated slotted member 82 and a pair of flat panels 82Y-1 and 82Y-2 coextending outwardly in substantially parallel alignment with one another from a common side of interior slot 82J. Slotted member 82 is composed of a top surface 84 and a pair of preferably slanted sides 86A and 86B coextending towards one another from a common side of the top surface 84. The slot 82J includes concave surfaces 88A and 88B extending outwardly from the terminal edge of slanted sides 86A and 86B respectively. Thus, slotted member 82 is a hollow elongated bar with a slot bounded by top surface 84, slanted sides 86A and 86B, and concave surfaces 88A and 88B as best illustrated in FIG. 5. Receiving slot 82J also includes a slit 84 running along the length of slot 82J. Slit opening 84 is formed along one side of slot 82J and is bounded by the terminal edges of concave surfaces 88A and 88B. Binder 80 further includes a pair of parallel panels 82Y-1 and 82Y-2 which coextend outwardly in spaced apart arrangement from the terminal edge of concave surfaces 88A and 88B, respectively along the length of slit 84. Thus a passageway is formed between panels 82Y-1 and 82Y-2 so that cover 90 may be inserted between these panels and thence into the interior of receiving slot 82J. Receiving slot 82J is formed of an upper slot portion 89A defined by slanted sides 86A, 86B and top surface 84; and a middle portion 89B which is defined by concave surfaces 88A and 88B.

Binder 80 further includes a lower receiving slot 83 which is defined by a pair of slanted side panels 82W-1 and 82W-2 which jut out from surface 88A along the bottom or receiving slot 82J. Panels 82W-1 and 82W-2 are slanted inwardly towards one another to form lower slot 83 of trapezoidal shape having an open bottom side as illustrated in FIG. 5. A multiplicity of binders 80 may be attached one to the other by simply sliding the upper slot 89A of one binder through the lower receiving slot 83 of another binder resulting in a stacking of individual binders securely held one to the other as illustrated in FIG. 5A.

Cover 90 of FIG. 5 is folded along a common looped edge 95. Looped edge 95 is readily insertable between panels 82Y-1 and 82Y-2 by simply inserting one end of looped edge 95 into one end of receiving slot 82J and sliding slot 82J along the length of looped edge 95. When within slot 82J, looped edge 95 will tend to take the configuration of either or both of portions 89A and 89B so as to prevent cover 90 from separating from binder 80 when the cover is opened. Also a number of sheets are readily inserted into cover 90 until the leading edge of the sheets presses against looped edge 95. There is sufficient friction of the panels 82Y-1 and 82Y-2 against cover 90 and sufficient friction between looped edge 95 and concave surfaces 88A and 88B to prevent separation of the cover from binder when the cover is opened. Also there is sufficient pressure exerted on cover 90 by panels 82Y-1 and 82Y-2 to prevent separation or slippage of the paper sheets from the binder when cover 90 is opened. Thus, both the cover 90 and paper sheets therein are held securely in place with the binder when the cover is opened. This embodiment also has the advantage of permitting the user to stack one binder onto the other as illustrated in FIG. 5A by simply sliding the upper slot portion 89A of one binder through the lower slot portion 83 of another binder. Any number of binders may be stacked in this manner. Similarly, the user may readily disassemble the binder one from the others by simply sliding the upper slot 89A of one binder out of the lower slot 83 of the attached binder.

Although specific methods and components for increasing friction between the cover and binder have been illustrated in the foregoing embodiments, it will be appreciated that the invention is not intended to be limited to the foregoing description. In particular it should be appreciated that the friction between cover and binder may be increased in any of the above-described embodiments by providng a plurality of folds on the cover in proximity to the folded edge or by coating the exposed surface of the cover with latex or equivalent friction material extending along the exposed surface of the cover in proximity to the folded edge. The present invention is also not intended to be limited to any particular shape or configuration of the binder, since other shapes or sizes for the component parts of the binder depending on the amount of paper to be contained therein may be substituted for those described without departing from the concept of the invention. Thus, the invention is not intended to be limited to the above-described embodiments but rather is defined by the claims and equivalents thereof.

I claim:

1. A folder comprising a folded cover and binder for the folder cover, said binder comprising an elongated bar having a pair of oppositely facing side walls defining an interior slot along the elongated bar's length, said side walls converging at a slit, and at least one member protruding into the slot from the interior side of at least one of said side walls, the member protruding in a direction away from the slit and the member forming an obtuse angle at its intersection with a section of the interior side of the side wall from which said member protrudes, wherein the folded cover comprises a sheet folded to form a pair of sheets having a common fold line and the pair of sheets folded again to form an overlapping flap terminating along said common fold line, the body of each of the pair of said sheets separable from one another, wherein the folded cover is inserted into the elongated bar so that the overlapping flap engages the protruding member along said common fold line.

2. A folder as defined in claim 1 wherein the folded cover is comprised of a thermoplastic material, and the overlapping flap is formed by a thermocrimping process.

3. A folder as defined in claim 1, wherein the overlapping flap is coated to provide increased rigidity.

4. A folder as defined in claim 1 wherein the member comprises a rib coextensive with said elongated bar.

5. A folder as defined in claim 1 wherein said section of the interior side of the side wall with which the protruding member forms an obtuse angle at its intersection therewith, extends from said intersection and terminates to form an edge of the slit.

6. A folder as defined in claim 4 wherein the member includes a pair of ribs, one appended to each of said side walls.

7. A folder as defined in claim 1 wherein the side walls comprise outwardly convex panels.

8. A folder as in claim 1 wherein the binder comprises a thermoplastic material selected from the group consisting of polystyrene, polypropylene, polyvinylchloride and nylon.

9. A folder as in claim 1 wherein the folded cover is comprised of a cast rolled thermoplastic selected from the group consisting of polyvinylchloride, polystyrene and polypropylene.

10. A folder comprising a folded cover and binder for the folded cover said binder comprising an elongated bar having a pair of oppositely facing side walls defining an interior slot along the elongated bar's length, said side walls converging at a slit, and at least one member protruding into the slot from the interior side of at least one of said side walls, the member protruding in a direction away from the slit, wherein the folded cover comprises a sheet folded to form a pair of sheets having a common fold line and the pair of sheets folded again to form an overlapping flap terminating along said common fold line, the body of each of the pair of said sheets separable from one another, wherein the folded cover is inserted into the elongated bar so that the overlapping flap engages the protruding member along said common fold line.

* * * * *